US012060891B2

(12) United States Patent
Meschino et al.

(10) Patent No.: US 12,060,891 B2
(45) Date of Patent: Aug. 13, 2024

(54) CENTRIFUGAL COMPRESSOR HAVING A BELLMOUTH WITH A STIFFENING MEMBER

(71) Applicant: PRATT & WHITNEY CANADA CORP., Longueuil (CA)

(72) Inventors: Matthew Meschino, Woodbridge (CA); Tibor Urac, Mississauga (CA); Raghavendra Pendyala, Montréal (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/509,958

(22) Filed: Oct. 25, 2021

(65) Prior Publication Data

US 2023/0129366 A1 Apr. 27, 2023

(51) Int. Cl.

| | |
|---|---|
| ***F04D 29/42*** | (2006.01) |
| ***F01D 25/04*** | (2006.01) |
| ***F04D 17/10*** | (2006.01) |

(52) U.S. Cl.

CPC ..... *F04D 29/4206* (2013.01); *F01D 25/04* (2013.01); *F04D 17/10* (2013.01); *F04D 29/4213* (2013.01)

(58) Field of Classification Search

CPC .. F04D 29/4206; F04D 29/4213; F04D 29/44; F04D 29/441

See application file for complete search history.

(56) References Cited

U.S. PATENT DOCUMENTS

| | | | | |
|---|---|---|---|---|
| 3,887,295 A | | 6/1975 | Yu | |
| 4,421,455 A | | 12/1983 | Tomren | |
| 4,436,481 A | * | 3/1984 | Linder | F04D 29/462 415/163 |
| 4,439,104 A | * | 3/1984 | Edmonds | F04D 29/462 415/161 |
| 4,531,356 A | * | 7/1985 | Linder | F04D 29/4213 60/726 |

(Continued)

OTHER PUBLICATIONS

European Search Report dated Jun. 3, 2023, EP Application No. 22203385.4 filed Oct. 24, 2022.

*Primary Examiner* — Justin D Seabe
*Assistant Examiner* — Behnoush Haghighian
(74) *Attorney, Agent, or Firm* — NORTON ROSE FULBRIGHT CANADA LLP

(57) ABSTRACT

A centrifugal compressor of an aircraft engine includes an impeller and a shroud extending circumferentially around the impeller. A bellmouth disposed upstream of the impeller extends circumferentially and includes: a conduit section extending from a first end to an upstream-most location of the bellmouth, the first end of the conduit section secured to the shroud, and a peripheral section extending from the upstream-most location to a second end located radially outwardly of the first end, the peripheral section located radially outwardly of the conduit section and axially overlapping the conduit section. A stiffening member is located on the peripheral section of the bellmouth proximate the second end. The stiffening member extends circumferentially and provides the bellmouth with a dynamic vibration mode outside a range of dynamic vibration modes of the aircraft engine during operation.

19 Claims, 4 Drawing Sheets

(56) References Cited

U.S. PATENT DOCUMENTS

| | | | | |
|---|---|---|---|---|
| 4,844,695 | A * | 7/1989 | Banks | F04D 29/444 415/161 |
| 5,373,691 | A * | 12/1994 | Gardner | F04D 29/4213 60/726 |
| 6,183,195 | B1 * | 2/2001 | Tremaine | F04D 27/023 415/173.2 |
| 6,968,697 | B2 * | 11/2005 | Nguyen | F02C 7/06 60/785 |
| 7,094,024 | B2 * | 8/2006 | Nguyen | F04D 29/681 415/185 |
| 8,206,097 | B2 * | 6/2012 | Nagai | F04D 29/663 415/220 |
| 8,511,971 | B2 * | 8/2013 | Hollman | F02C 3/05 415/196 |
| 8,579,591 | B2 | 11/2013 | Ho et al. | |
| 9,377,030 | B2 * | 6/2016 | Matwey | F04D 29/4213 |
| 10,161,785 | B2 | 12/2018 | Pepe et al. | |
| 10,935,049 | B2 * | 3/2021 | Yasuda | F04D 25/08 |
| 2005/0158173 | A1 * | 7/2005 | Nguyen | F04D 29/444 415/208.3 |
| 2008/0152500 | A1 * | 6/2008 | Mehring | F02C 7/052 416/181 |
| 2010/0068044 | A1 * | 3/2010 | Nagai | F04D 29/667 415/182.1 |
| 2011/0274537 | A1 | 11/2011 | Duong et al. | |
| 2012/0020771 | A1 * | 1/2012 | Hollman | F02C 7/06 415/121.2 |
| 2014/0294564 | A1 * | 10/2014 | Matwey | F04D 29/444 415/58.3 |
| 2021/0164489 | A1 * | 6/2021 | Joly | F04D 29/441 |

* cited by examiner

CENTRIFUGAL COMPRESSOR HAVING A BELLMOUTH WITH A STIFFENING MEMBER

TECHNICAL FIELD

The application relates generally to aircraft engines and, more particularly, to compressors of aircraft engines.

BACKGROUND

Aircraft engines, such as gas turbine engines, often include a centrifugal compressor having an impeller. A shroud is disposed around the impeller to contain the flow within flow passages defined between blades of the impeller. A bellmouth may in certain configurations be fixed to the shroud, upstream of the impeller, and is used to converge and guide an airflow toward an inlet of the impeller. In use, the bellmouth may suffer from high-cycle fatigue. Hence, improvements are sought.

SUMMARY

There is accordingly provided a centrifugal compressor of an aircraft engine, comprising: an impeller rotatable about a central axis; a shroud extending circumferentially around the impeller, the impeller rotatable relative to the shroud about the central axis; a bellmouth disposed upstream of the impeller relative to a flow through the centrifugal compressor, the bellmouth extending circumferentially around the central axis and including: a conduit section extending from a first end to an upstream-most location of the bellmouth, the first end of the conduit section secured to the shroud, the conduit section defining a conduit having a converging flow passage area leading to the impeller, and a peripheral section extending from the upstream-most location to a second end located radially outwardly of the first end, the peripheral section located radially outwardly of the conduit section and axially overlapping the conduit section; and a stiffening member on the peripheral section of the bellmouth proximate the second end, the stiffening member extending circumferentially around the central axis the stiffening member providing the bellmouth with a dynamic vibration mode outside a range of dynamic vibration modes of the aircraft engine during operation.

There is further provided a bellmouth to be disposed upstream of an impeller of a centrifugal compressor, comprising: an annular body extending circumferentially around a central axis, the annular body having a conduit section and a peripheral section, the annular body extending from a first end in an axially rearward and radially outward direction to an annular apex along the conduit section and extending in an axially forward and radially outward direction from the annular apex to a second end along the peripheral section; and a stiffening member connected to the peripheral section of the bellmouth.

BRIEF DESCRIPTION OF THE DRAWINGS

Reference is now made to the accompanying figures in which.

DETAILED DESCRIPTION

Figure 1:
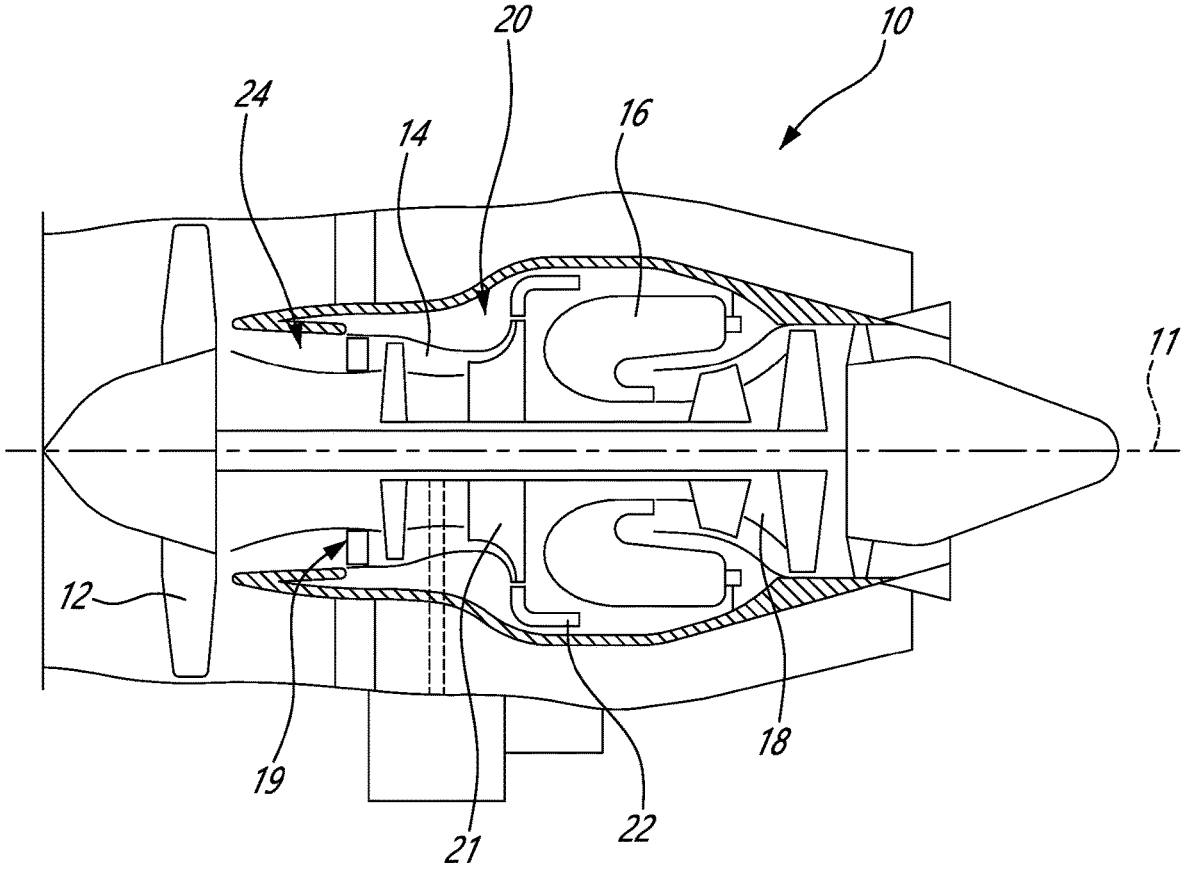
FIG. 1 is a schematic cross-sectional view of an aircraft engine depicted as gas turbine engine.

FIG. 1 illustrates an aircraft engine depicted as a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The fan 12, the compressor section 14, and the turbine section 18 rotate about a central axis 11 of the gas turbine engine 10.

The compressor section 14 may include an axial compressor 19, which may include one or more stage, each including stator vanes and rotor blades. The compressor section 14 further includes a centrifugal compressor 20 located downstream of the axial compressor 19 relative to a flow in an annular gaspath 24 of the gas turbine engine 10. The centrifugal compressor 20 includes an impeller 21 and a diffuser 22 located downstream of the impeller 21. The axial compressor 19 may be referred to as a low-pressure compressor whereas the centrifugal compressor 20 may be referred to as a high-pressure compressor.

Figure 2:
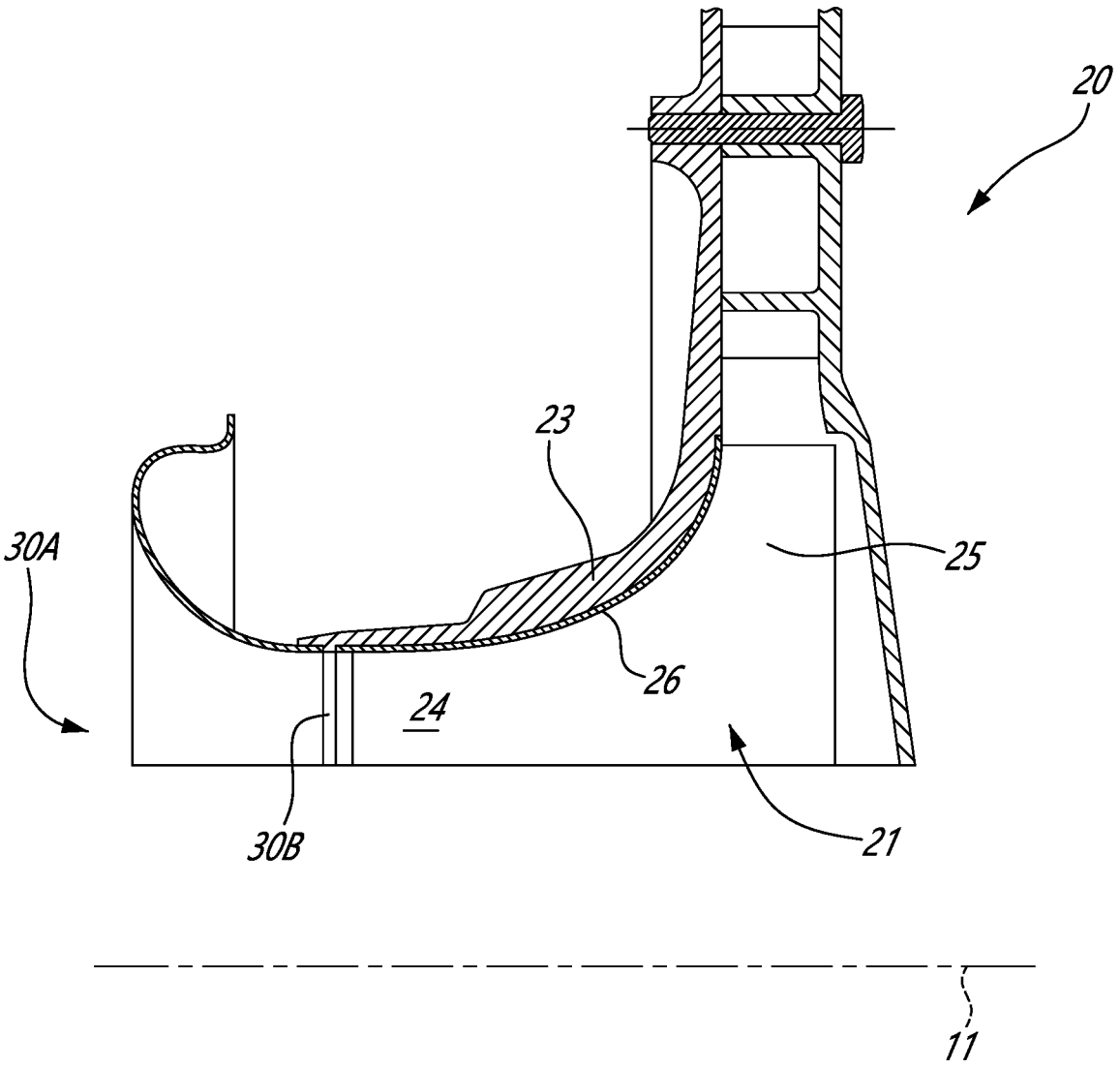
FIG. 2 is a cross-sectional view of a portion of a compressor section of the gas turbine engine of FIG. 1.

Referring now to FIG. 2, the centrifugal compressor 20 is illustrated in greater detail. The centrifugal compressor 20 includes a shroud 23 disposed around the impeller 21. The impeller 21 is rotatable relative to the shroud 23 around the central axis 11. The shroud 23 is used to contain a flow of air with the annular gaspath 24. The annular gaspath 24 extends within flow passages defined between blades 25 of the impeller 21. The blades 25 are circumferentially distributed around the central axis 11 and extend from a hub of the impeller 21 to tips 26. The shroud 23 is spaced apart from the tips 26 to limit rubbing and tip leakage.

In the embodiment shown, a bellmouth 30 is secured to the shroud 23 upstream of the impeller 21. The bellmouth 30 is used to guide the flow toward the impeller 21. Herein, the expression "secured" implies both directly and indirectly secured to. For instance, the bellmouth 30 may be directly secured to the shroud 23 or secured to the shroud 23 via an intermediary component, such as a bracket, another structural component of the engine, and so on.

Figure 3:
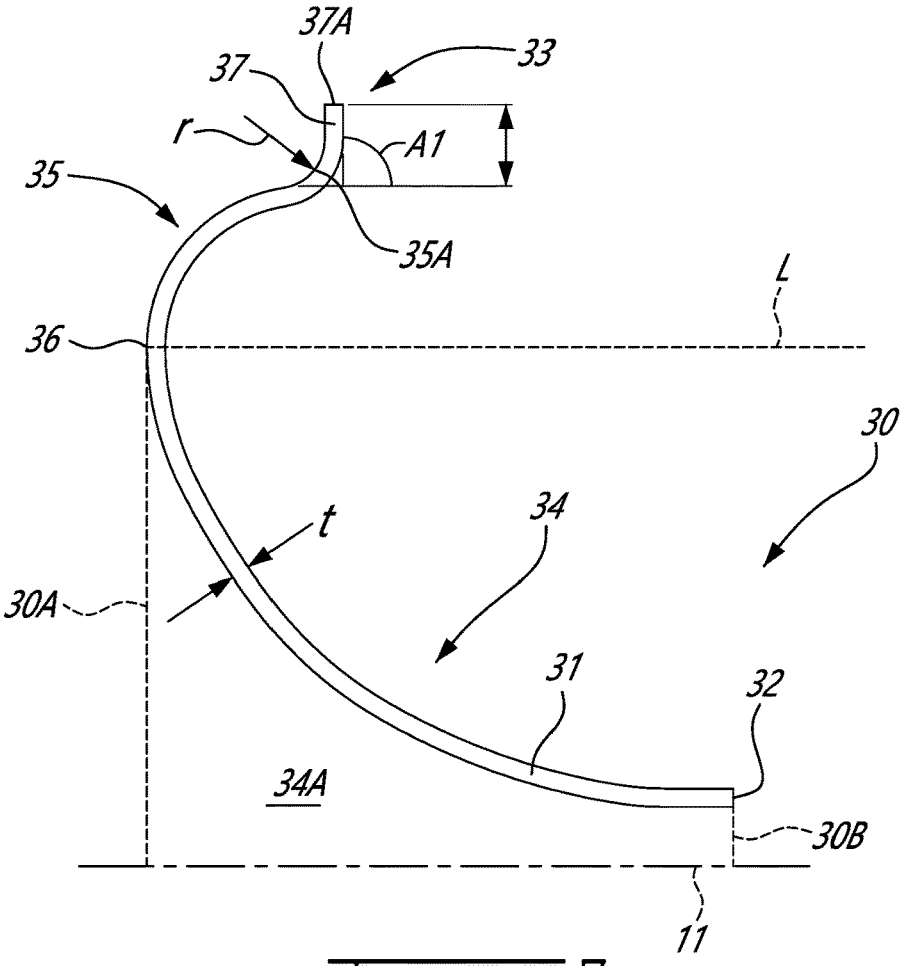
FIG. 3 is a cross-sectional view of a bellmouth to be disposed upstream of an impeller of the compressor section of FIG. 2.

Referring to FIG. 3, the bellmouth 30 has an inlet 30A and an outlet 30B located downstream of the inlet 30A relative to the flow through the centrifugal compressor 20. The bellmouth 30 has an annular body 31 extending annularly around the central axis 11. The annular body 31 may be a monolithic piece of material extending a full circumference around the central axis 11. The annular body 31 may be made of sheet metal having a thickness t selected to provide the desired stiffness. In some embodiments, the bellmouth 30 may include a plurality of sections secured to one another and circumferentially distributed around the central axis 11.

The bellmouth 30 has a first end 32 proximate the shroud 23 and a second end 33, which may also be referred to as a free end, located radially outwardly of the first end 32 relative to the central axis 11. The first end 32 may define the outlet 30B of the bellmouth 30. The first end 32 may be secured to the shroud 23 for instance via brazing or any other suitable way. In the embodiment shown, the bellmouth 30 is secured to the shroud 23 solely via the first end 32. That is, the bellmouth 30 may be cantilevered and the second end 33 may be free from connection to a structural component of the gas turbine engine 10. The bellmouth 30 may be connected to a remainder of the gas turbine engine 10 solely via the first end 32. In some operating conditions, high cycle fatigue may be detrimental to the cantilevered bellmouth 30 since it may lead to crack propagation. It was observed that prior bellmouths may have fundamental dynamic modes in the operating range (natural frequencies) that can be excited by the gas turbine engine 10. The bellmouth 30 of the present disclosure may at least partially alleviate these drawbacks.

The bellmouth 30 includes a conduit section 34 and a peripheral section 35 that extends around the conduit section 34. The peripheral section 35 is located radially outwardly of the conduit section 34 and axially overlaps the conduit section 34 relative to the central axis 11. The conduit section 34 is located below line L of FIG. 3 and the peripheral section 35 is located above the line L. An upstream-most location 36 of the bellmouth 30 radially registers with the line L and divides the bellmouth 30 between the conduit section 34 and the peripheral section 35. The conduit section 34 defines a conduit 34A via which the flow flows from the inlet 30A to the outlet 30B of the bellmouth 30. The conduit 34A as a converging flow area leading to the impeller 21. That is, a cross-sectional area of the conduit 34A taken on a plane normal to the central axis 11 decreases from the inlet 30A to the outlet 30B of the bellmouth 30. The conduit section 34 may have an elliptical profile, but any suitable profile may be used.

The annular body 31 of the bellmouth 30 extends circumferentially around the central axis 11 and extends from the first end 32 in an axially rearward and radially outward direction to an annular apex, which corresponds to the upstream-most location 36 of the bellmouth 30, along the conduit section 34 and extends in an axially forward and radially outward direction from the annular apex or upstream-most location 36 to the second end 33 along the peripheral section 35.

The conduit section 34 extends from the first end 32, which is secured to the shroud 23, to the upstream-most location 36 of the bellmouth 30. The peripheral section 35 extends from the upstream-most location 36 to the second end 33 located radially outwardly of the first end 32. The upstream-most location 36 may define a location of the inlet 30A of the bellmouth 30, but this may not be the case in all operating conditions since the inlet 30A is defined by a stagnation line that extends circumferentially all around the bellmouth 30. In some operating conditions, the stagnation line may register with the upstream-most location 36.

In the embodiment shown, the bellmouth 30 includes a stiffening member that is connected to the peripheral section 35 proximate the second end 33. The stiffening member may register with the second end 33 of the bellmouth 330. The stiffening member is used to increase a stiffness of the bellmouth 30 such that its natural vibration frequency becomes outside frequencies of vibrations generated by the gas turbine engine 10. This may prevent vibrations from damaging the bellmouth 30 via high-cycle fatigue. The stiffening member may provide the bellmouth 30 with a dynamic vibration mode outside a range of dynamic vibration modes of the aircraft engine during operation.

In the embodiment shown, the stiffening member is a stiffening lip 37 defined by the annular body 31 of the bellmouth 30. The stiffening lip 37 may extend annularly all around the central axis 11. The peripheral section 35 may extend from the upstream-most location 36 and may end with the stiffening lip 37. The stiffening lip 37 may extend in a direction having a radial component relative to the central axis 11. In the present case, the stiffening lip 37 defines an angle A1 with a remainder of the peripheral section 35. The angle A1 may range from 45 degrees to 135 degrees. The angle A1 extends from a line parallel to the central axis 11 to the stiffening lip 37 in a counter clockwise direction as shown in FIG. 3. In the embodiment of FIG. 3, the stiffening lip 37 extends radially outwardly from the remainder of the peripheral section 35. The stiffening lip 37 may extend solely radially relative to the central axis 11. Herein, the stiffening lip 37 extends away from the conduit section 34 of the bellmouth 30.

As shown in FIG. 3, the peripheral section 35 includes a curved portion 35A. The stiffening lip 37 is connected to the remainder of the peripheral section 35 via the curved portion 35A. In the present case, a ratio of a radius of curvature r of the curved portion to the thickness t of the annular body 31 ranges from 1 to 10, preferably, the ratio of the radius r to the thickness t is about 2.33. Unless indicated otherwise, the expression "about" as used herein with respect to specific values is understood to include variations of plus or minus 10% of the numerical value identified. In the present embodiment, an edge 37A of the stiffening lip 37, which herein also corresponds to an edge of the annular body 31, is spaced apart from the remainder of the peripheral section 35 by a distance d. A ratio of the distance d to the thickness t of the annular body 31 may range from 1 to 20, and may be preferably about 4.8.

Figure 4:
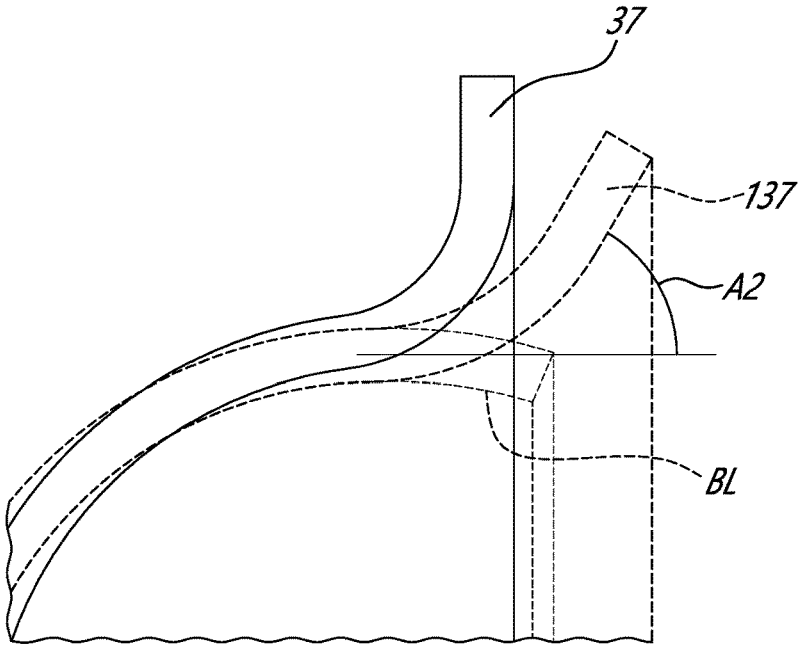
FIG. 4 is an enlarged view of a portion of the bellmouth of FIG. 3 and illustrating an alterative embodiment of an impeller.

Referring now to FIG. 4, a baseline configuration BL of the bellmouth without a stiffening member is shown superposed with the stiffening lip 37 described herein above with reference to FIG. 3 and with a stiffening lip 137 in accordance with another embodiment. As shown, an angle A2 between the stiffening lip 137 and a line parallel to the central axis 11 is about 60 degrees.

Figure 5:
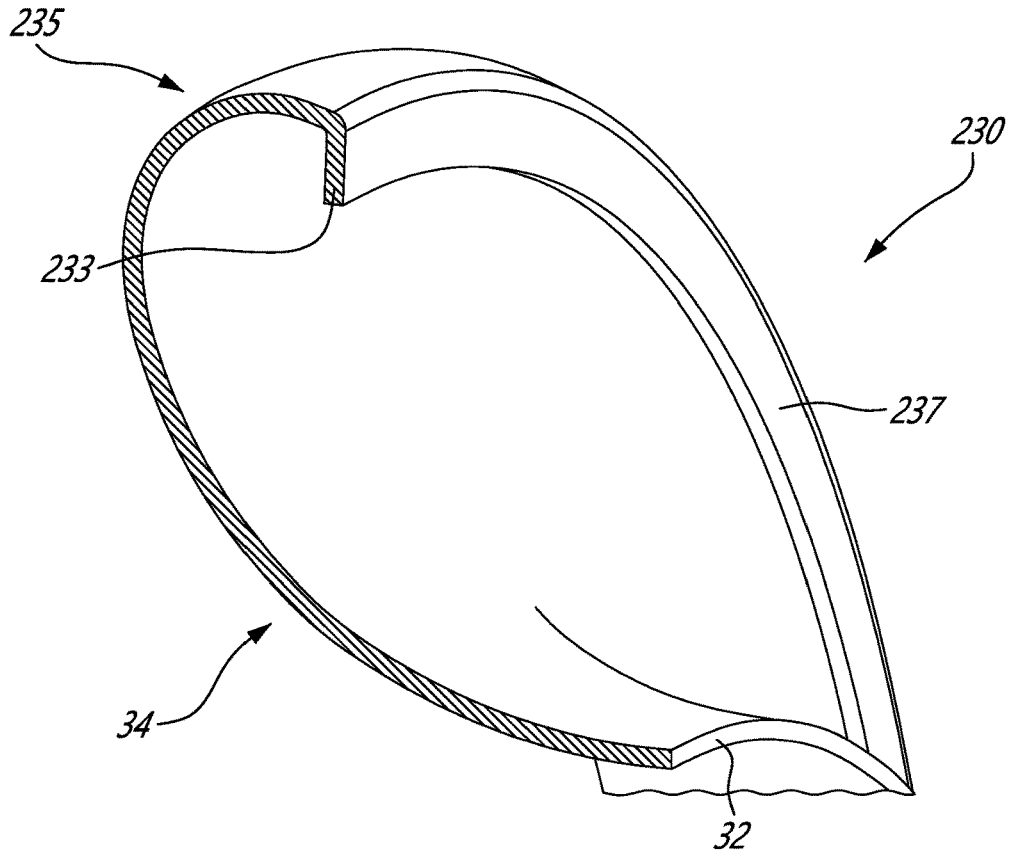
FIG. 5 is a three dimensional cutaway view of a bellmouth in accordance with another embodiment.

Referring now to FIG. 5, another embodiment of a bellmouth is shown at 230. For the sake of conciseness, only elements differing from the bellmouth 30 described above with reference to FIG. 2 are described below. The bellmouth 230 includes a stiffening lip 237 that protrudes radially inwardly, toward the central axis 11, from a remainder of the peripheral section 235. The stiffening lip 237 ends at the second end 233 of the bellmouth 230. In the embodiment shown, the stiffening lip 237 extends toward the central axis 11 in a direction being solely radial. The stiffening lip 237 extends toward the conduit section 34 of the bellmouth 230. In some embodiments, the stiffening lip 237 may extend toward the central axis 11 along a direction having both a radial and an axial component relative to the central axis 11.

Figure 6:
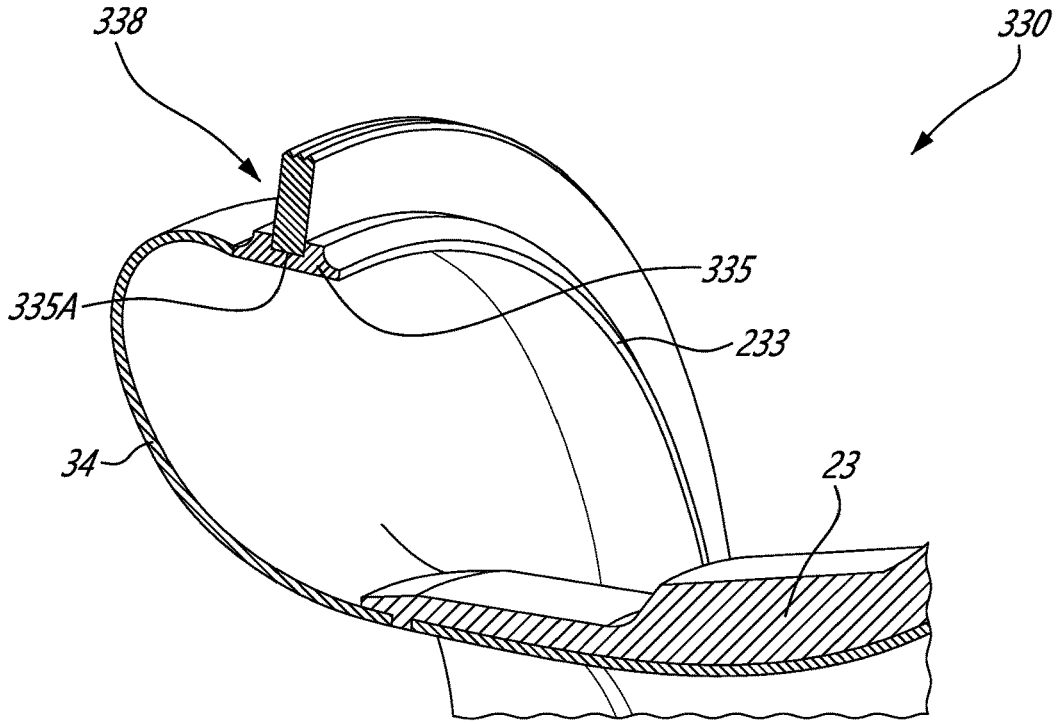
FIG. 6 is a three dimensional cutaway view of a bellmouth in accordance with yet another embodiment.

Referring now to FIG. 6, another embodiment of a bellmouth is shown at 330. For the sake of conciseness, only elements differing from the bellmouth 30 described above with reference to FIG. 2 are described below. In the present embodiment, the bellmouth 330 includes stiffening ring 338 that is secured to the peripheral section 335 proximate the second end 333. The stiffening ring 338 may register with the second end 333 of the bellmouth 330. The stiffening ring 338 may extend annularly all around the central axis 11. In the present embodiment, the peripheral section 335 that defines a groove 335A. The groove 335A may extend all around the central axis 11. A stiffening ring 338 may be received within the groove 335A. The stiffening ring 338 may include a plurality of rings. The stiffening ring 338 herein extends from the peripheral section 335 and away from the central axis 11. In other words, the stiffening ring 338 may extend radially outwardly relative to the central axis 11. It may alternatively extend radially inwardly. The groove 335A that receives the stiffening ring 338 may be offset from the second end 333 of the bellmouth 330.

It will be appreciated that any stiffening means for increasing a stiffness of the bellmouth may be used without departing from the scope of the present disclosure. For instance, the stiffening member may include an increased thickness of material at the peripheral section of the bellmouth. In some embodiments, the bellmouth may be formed with a reinforcing rib at its peripheral section. The reinforcing rib may be made by bending the annular body of the bellmouth.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A centrifugal compressor of an aircraft engine, comprising:

an impeller rotatable about a central axis;

a shroud extending circumferentially around the impeller, the impeller rotatable relative to the shroud about the central axis;

a bellmouth disposed upstream of the impeller relative to a flow through the centrifugal compressor, the bellmouth extending circumferentially around the central axis and including:

a conduit section extending from a first end to an upstream-most location of the bellmouth, the first end of the conduit section secured to the shroud, the conduit section defining a conduit having a converging flow passage area leading to the impeller, and a peripheral section extending from the upstream-most location to a second end located radially outwardly of the first end, the peripheral section located radially outwardly of the conduit section and axially overlapping the conduit section; and a stiffening member on the peripheral section of the bellmouth proximate the second end, the stiffening member extending circumferentially around the central axis, the second end and the peripheral section both free of connection to a structural component of the aircraft engine, the stiffening member transversally intersecting a remainder of the peripheral section at a location between the upstream-most location and the second end, the stiffening member extending away from the location in a direction having a radial component relative to the central axis, a ratio of a radius of curvature of the curved portion to a thickness of the annular body ranging from 1 to 10, the stiffening member configured to increase a stiffness of the bellmouth, a natural vibration frequency of the bellmouth with the stiffener being outside frequencies of vibrations generated by the aircraft engine.

2. The centrifugal compressor of claim 1, wherein the stiffening member is a stiffening lip defined by an annular body of the bellmouth.

3. The centrifugal compressor of claim 2, wherein the peripheral section extends from the upstream-most location and ends with the stiffening lip, the stiffening lip extending in a direction having a radial component relative to the central axis.

4. The centrifugal compressor of claim 3, wherein the stiffening lip defines an angle with a remainder of the peripheral section.

5. The centrifugal compressor of claim 4, wherein the angle ranges from 45 degrees to 135 degrees.

6. The centrifugal compressor of claim 2, wherein the stiffening lip extends radially outwardly from a remainder of the peripheral section.

7. The centrifugal compressor of claim 6, wherein the stiffening lip extends solely radially relative to the central axis.

8. The centrifugal compressor of claim 2, wherein the peripheral section includes a curved portion, the stiffening lip connected to a remainder of the peripheral section via the curved portion.

9. The centrifugal compressor of claim 1, wherein the ratio is about 2.33.

10. The centrifugal compressor of claim 2, wherein an edge of the stiffening lip is spaced apart from a remainder of the peripheral section by a distance, a ratio of the distance to a thickness of the annular body ranging from 1 to 20.

11. The centrifugal compressor of claim 10, wherein the ratio is about 4.8.

12. The centrifugal compressor of claim 1, wherein the stiffening member is a stiffening ring secured to the peripheral section.

13. The centrifugal compressor of claim 12, wherein the stiffening ring is received within a groove defined by the peripheral section.

14. The centrifugal compressor of claim 13, wherein the stiffening ring extends radially outwardly from the bellmouth.

15. An aircraft engine, comprising:

a compressor; and a bellmouth disposed upstream of the compressor, the bellmouth having:

an annular body extending circumferentially around a central axis, the annular body having a conduit section and a peripheral section, the annular body extending from a first end in an axially rearward and radially outward direction to an annular apex along the conduit section and extending in an axially forward and radially outward direction from the annular apex to a second end along the peripheral section, the second end and the peripheral section both free of connection to a structural component of the aircraft engine; and a stiffening member connected to the peripheral section of the bellmouth, the stiffening member transversally intersecting the peripheral section at a location between the annular apex and the second end, the stiffening member extending away from the location in a direction having a radial component relative to the central axis, an edge of the stiffening member is spaced apart from a remainder of the peripheral section by a distance taken along a radial direction, a ratio of the distance to a thickness of the annular body ranging from 1 to 20, the stiffening member configured to increase a stiffness of the bellmouth, a natural vibration frequency of the bellmouth with the stiffener being outside frequencies of vibrations generated by the aircraft engine.

16. The aircraft engine of claim 15, wherein the stiffening member is a stiffening lip defined by the annular body, the stiffening lip being angled relative to a remainder of the peripheral section.

17. The aircraft engine of claim 16, wherein an angle between the stiffening lip and a line parallel to the central axis ranges from 45 degrees to 135 degrees.

18. The aircraft engine of claim 16, wherein the stiffening lip extends radially outwardly to the second end.

19. The aircraft engine of claim 15, wherein the stiffening member is a stiffening ring secured to the peripheral section of the annular body.

* * * * *